United States Patent [19]

Dolfi

[11] Patent Number: 4,462,440

[45] Date of Patent: Jul. 31, 1984

[54] REPEATABLE DOVETAIL JIG

[76] Inventor: John J. Dolfi, R.D. #1, Box 314, Belle Vernon, Pa. 15012

[21] Appl. No.: 556,560

[22] Filed: Nov. 30, 1983

Related U.S. Application Data

[63] Continuation-in-part of Ser. No. 475,360, Mar. 14, 1983, abandoned.

[51] Int. Cl.[3] ..... B27F 1/00

[52] U.S. Cl. ..... 144/144.5 R; 144/144.5 GT; 144/85; 83/761

[58] Field of Search ..... 144/85, 144.5, 144.5 GT; 145/129; 83/761, 746; 269/295, 87.2, 41

[56] References Cited

U.S. PATENT DOCUMENTS 592,139 10/1897 Griffith ..... 83/761

*Primary Examiner*—W. D. Bray
*Assistant Examiner*—Jorji M. Griffin
*Attorney, Agent, or Firm*—Webb, Burden, Robinson & Webb

[57] ABSTRACT

A jig for cutting pins and tails in the edges of boards for use in forming a dovetail joint between the boards. The jig has a rectangular base with a first leg attached along one elongated edge and extending at a right angle to one surface of the base and a second leg attached along the opposite elongated edge and extending at a right angle to the other surface of the base. The first leg has a plurality of angled saw guide kerfs and a plurality of angled saw guide kerfs located in the base are connected with the saw guide kerfs in the first leg for cutting tails. The second leg has a plurality of angled saw guide kerfs and a plurality of angled saw guide kerfs located in the base are connected with the saw guide kerfs in the second leg for cutting pins. Adjustment screws may extend through the first leg to adjust the tolerance between the pins and the tails.

6 Claims, 6 Drawing Figures

REPEATABLE DOVETAIL JIG

This application is a continuation-in-part application of Ser. No. 475,360, filed Mar. 14, 1983 now abandoned.

BACKGROUND OF THE INVENTION

1. Field of the Invention

The invention relates generally to a jig for guiding a hand saw when cutting tails and pins in boards to make a dovetail joint between two perpendicular boards when making items such as drawers and boxes. More particularly, the invention relates to a portable jig for cutting both tails and pins in boards for making a dovetail joint between two boards. Both the tails and the pins in the dovetail joint are properly spaced along the edges of the boards and accurately dimensioned so that the pins and tail slots fit snugly together when the wooden drawer, box or other item is assembled. Use of the jig makes it possible to repeatedly cut both the tails and the pins along the edges of boards with consistent accuracy and without measuring or time consuming layout.

2. Description of the Prior Art

Devices for cutting tails and pins to form a dovetail joint are disclosed in U.S. Pat. Nos. 592,139; 1,541,134 and 3,057,383. The devices disclosed in the latter two patents are directed to complex jigs having complicated aligning and clamping arrangements for holding a board to be cut in position and requiring accurate location of a board in the device prior to making a cut. Because of their complexity and resultant high cost and the detailed and accurate adjustment required, these devices are not practical for use by relatively unskilled home craftsmen. The devices disclosed in U.S. Pat. No. 592,139 are relatively simply but are not practical because four individual miter boxes are required to cut the tails and the pins, and it requires detailed and accurate adjustment of a gage block on the end of each miter box to position the boards in the miter box so that sequential cuts will be properly spaced and are consistently repeatable. Additionally, the devices disclosed in U.S. Pat. No. 592,139 require measurements and layout prior to cutting both the pins and the tails. The measurements must be accurately repeated which increases the probability of error in cutting sequential pins and tails which must have consistent size and spacing to form a tight dovetail joint.

SUMMARY OF THE INVENTION

The invention is directed to a portable jig having a plurality of saw guide kerfs at different angles to cut both pins and tails in boards of different thicknesses for making dovetail joints. The jig permits the saw guide kerfs to be located along the edge of a board to be cut so that each pin will fit snugly in a tail slot between adjacent tails without the necessity of filing or paring after the pins and tails are cut. The jig permits a board of any length to be cut without any measuring or layout so that the jig may be easily used by a home craftsman having little or no skill in woodworking to make consistently tight and neat dovetail joints. The jig may be made of wood, metal or plastic and is inexpensive. The jig may be provided with adjustment screws which can be set to obtain the desired tolerance between the pins and the tails.

DESCRIPTION OF THE PREFERRED EMBODIMENTS

Figure 1:
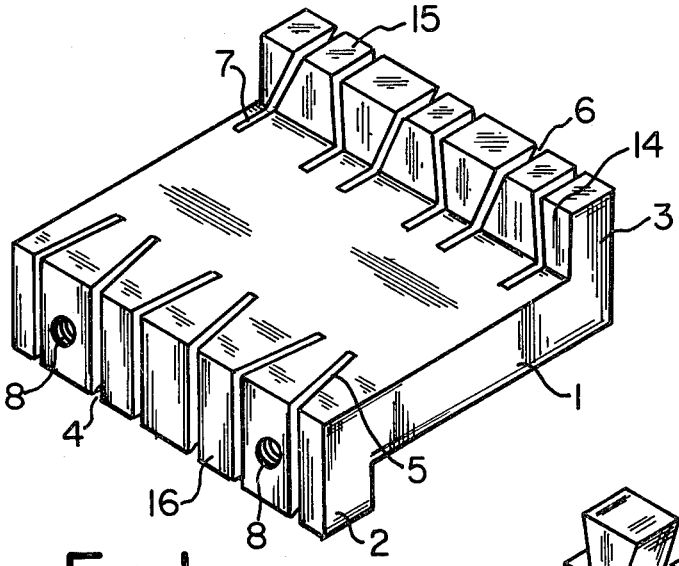
FIG. 1 is a perspective view of the jig.

With reference to FIGS. 1–5 of the drawings, the jig comprises a flat base 1 having a first right angle leg 2 at one elongated edge and a second right angle leg 3 at the opposite elongated edge. The legs extend in opposite directions from base 1 so that the jig has a flattened Z-shape in cross section. The leg 2 is the tail cutting leg and is provided with a plurality of angular saw guide kerfs 4 which are continuous with angular saw guide kerfs 5 in base 1. Each adjacent pair of guide kerfs 5 define an inner included angle of 24°, and each individual guide kerf 5 is at an angle of 12° to an imaginary line on base 1 perpendicular to the elongated edge of base 1 and located at the intersection of guide kerf 5 and guide kerf 4. Guide kerfs 4 have the same angle through leg 2 as guide kerfs 5.

Leg 3 is the pin cutting leg and is provided with a plurality of saw guide kerfs 6 which are continuous with saw guide kerfs 7 in base portion 1. The inner included angle between adjacent kerfs 6 in leg 3 is also 24°. Guide kerfs 7 in base 1 have the same angle as guide kerfs 6. While guide kerfs 5 and 6 have been shown and described with an included angle of 24°, it will be understood by those skilled in the art that the angle may vary depending upon the type of pins and tails to be cut. Each kerf may be at a 90° angle to the edge of the base of the jig if the jig is to be used to cut fingers and slots for making a finger joint.

The leg 2 of the jig is provided with spaced tapped holes 8 which receive threaded adjustment screws 9 having a stop nut 10 threaded along the length of shaft 11. The position of the ends of the adjustment screws relative to the inner surface 13 of leg 2 permit adjustment of the tolerance between the pins and the tails. This tolerance is normally controlled by inserting shims having the desired thickness between the edge of the board B′ having tails cut therein and the inner surface 13 of leg 2 of jig base 1 when the jig is placed on the edge of board B′. It will be understood by those skilled in the art that the number of adjustment screws will vary with the length of the jig.

Figure 6:
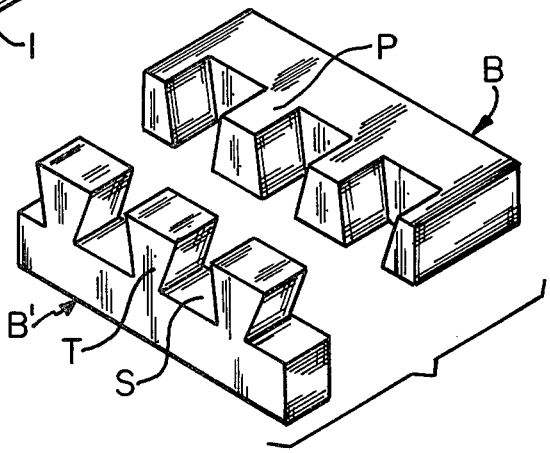
FIG. 6 is a perspective view of two boards cut to form a dovetail joint.

With specific reference to FIGS. 1 and 6 of the drawings, a board B to be cut with pins is placed in a carpenter's vise, and the jig is placed on the upper edge of the board with the surface of base 1 lying against the face of the board and the inner surface 14 of leg 3 lying on the upper edge of the board. Cuts are made by sequentially placing the saw in saw guide kerfs 6 and cutting downwardly into the board following kerfs 7. The depth of each cut is determined by a depth stop which is clamped on the saw. By repeating this procedure along the length of the jig, a plurality of pins P are cut along the edge of a board B below pin guides 15. The material in the board B between pins P is waste and is readily removed from the board with a wood chisel or a coping saw.

The edge of a board B′ which will form the other right angle wall of a drawer or box is cut by reversing the jig so that the inner surface 13 of leg 2 faces on the upper edge of a board B′ held in a carpenter'vise. Either shims or the ends of adjustment screws 9 contact the upper edge of the board B′, and the saw is sequentially placed in guide kerfs 4 and cuts downwardly through kerfs 5 in the base of the jig until the saw is stopped by the depth stop on the saw. By repeating this procedure along the length of the jig, a plurality of tails T are cut in the edge of the board B′ below the tail guides 16. The material between the tails is removed from the board with a wood chisel or a coping saw to form spaced tail slots S which receive pins P when boards B and B′ are joined at a right angle.

When it is desired to cut either more pins or tails along the edge of a board than the kerfs which are available in the jig, the jig is merely moved along the upper edge of the board which is held in the vise and additional pins or tails are cut. It will be obvious to those skilled in the art that the length of the jig may be as long as is practical depending upon the length of the boards to be cut. Furthermore, it will be obvious to those skilled in the art that no measuring or layout is needed when using the jig since after cutting the maximum number of tails or pins dictated by the length of the jig, it is only necessary to slide the jig along the upper edge of the board until the last saw guide kerf is accurately aligned with the last cut in the edge of the board which will properly position the jig to cut more tails or pins by using the saw in the adjacent saw guide kerfs. The thickness of the board is immaterial since the jig is laid on one edge of the board and the saw is guided by the guide kerfs in the jig as it cuts the full thickness of the board. In order to insure stability, the jig may be held firmly to the board being cut with clamps which prevent movement of the jig relative to the edge of the board while making consecutive cuts.

Figure 2:
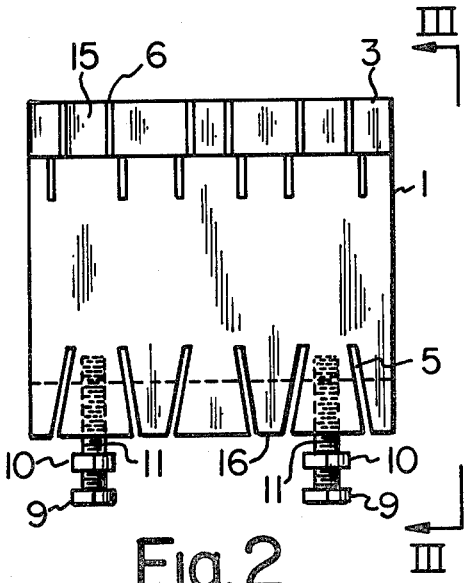
FIG. 2 is a plan view of the jig shown in FIG. 1 with two adjustment screws extending through the tail cutting leg.
Figure 5:
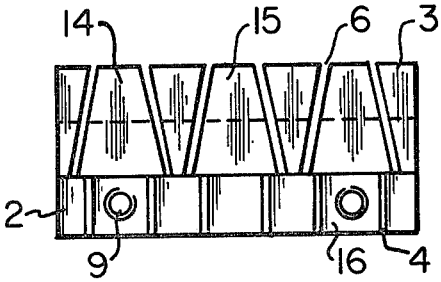
FIG. 5 is an elevation on line V—V of FIG. 3.
Figure 4:
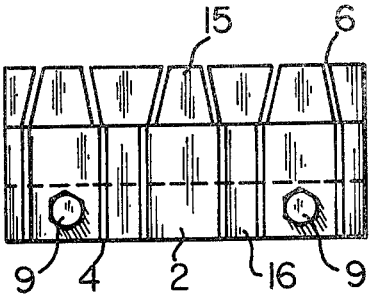
FIG. 4 is an elevation on line IV—IV of FIG. 3.
Figure 3:
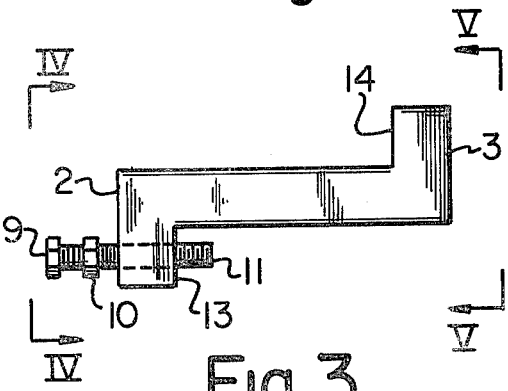
FIG. 3 is an end view on line III—III of FIG. 2.

Adjustment screws 9 are threaded into tapped holes 8 extending through leg 2 of the jig as shown in FIGS. 2–4 of the drawings. These adjustment screws are set to hold the inner surface 13 of leg 2 away from the edge of board B′ to obtain the desired tolerance between the pins cut along the edge of board B and the tail slots S which are defined by the tails T cut along the edge of board B′. Each adjustment screw is positioned by adjusting a stop nut 10 along the length of shaft 11 so that the stop nuts abut the outer surface of leg 2 of the jig.

While preferred embodiments of the invention have been described and shown herein, it is to be understood that the invention may be embodied within the scope of the appended claims.

I claim:

1. A jig having a flattened Z-shaped cross section for cutting pins and tails in the edges of boards so that the boards can be connected by a dovetail joint, said jig comprising a rectangular base having spaced parallel elongated edges, a first leg attached along one elongated edge of said base and extending at a right angle to one surface of said base, a second leg attached along the opposite elongated edge of said base and extending at a right angle to the other surface of said base, said first leg having a plurality of angled saw guide kerfs therein and a plurality of saw guide kerfs in said base connected with said saw guide kerfs in said first leg, said second leg having a plurality of angled saw guide kerfs therein and a plurality of saw guide kerfs in said base connected with said saw guide kerfs in said second leg, whereby said saw guide kerfs in said first leg and the connected kerfs in said base cut the tails of a dovetail joint and said saw guide kerfs in said second leg and the connected saw guide kerfs in said base cut the pins of a dovetail joint.

2. A jig as set forth in claim 1 wherein each pair of saw guide kerfs in said first leg are angled away from each other and the connected saw guide kerfs in said base having the same angle and each pair of saw guide kerfs in said second leg are angled away from each other and the connected saw guide kerfs in said base have the same angle.

3. A jig as set forth in claim 1 including at least one tapped hole extending through said first leg and a threaded adjustment screw in said hole, whereby said adjustment screw may be positioned in said tapped hole to locate the end of said adjustment screw to adjust the tolerance between the pins and the tails.

4. A jig as set forth in claim 2 including at least one tapped hole extending through said first leg and a threaded adjustment screw in said hole, whereby said adjustment screw may be positioned in said tapped hole to locate the end of said adjustment screw to adjust the tolerance between the pins and the tails.

5. A jig as set forth in claim 3 including a stop nut on said threaded adjustment screw.

6. A jig as set forth in claim 4 including a stop nut on said threaded adjustment screw.

* * * * *